United States Patent [19]

Malgarini et al.

[11] 4,082,545

[45] Apr. 4, 1978

[54] REDUCTION OF IRON ORE IN FLUIDIZED BED REACTORS

[75] Inventors: Giansilvio Malgarini; Edoardo Pasero, both of Rome; Giorgio Alitta, Genoa; Cristiano De Candida, Genoa; Carlo Raggio, Genoa, all of Italy

[73] Assignees: Istituto di Ricerca Finsider per la Riduzione Diretta S.p.A., Rome; Italimpianti S.p.A., Genoa, both of Italy; part interest to each

[21] Appl. No.: 711,458

[22] Filed: Aug. 4, 1976

[30] Foreign Application Priority Data

Aug. 5, 1975 Italy ..... 50827 A/75

[51] Int. Cl.[2] ..... C21B 13/02

[52] U.S. Cl. ..... 75/35; 75/26; 75/91

[58] Field of Search ..... 75/26, 91, 34–37, 75/25, 9

[56] References Cited

U.S. PATENT DOCUMENTS

| | | | |
|---|---|---|---|
| 2,900,246 | 8/1959 | Keith et al. | 75/26 |
| 3,288,590 | 11/1966 | Keith et al. | 75/35 |
| 3,364,011 | 1/1968 | Porter, Jr. et al. | 75/26 |
| 3,389,988 | 6/1968 | Cambon et al. | 75/26 |
| 3,984,229 | 10/1976 | Gorling | 75/26 |

*Primary Examiner*—M. J. Andrews

*Attorney, Agent, or Firm*—Young & Thompson

[57] ABSTRACT

Iron ore is introduced in a series of fluidized bed reactors, with a reducing gas that is heated before each bed and cooled after each bed and thereafter washed with water so as to remove from the gas the very fine powder of solids which otherwise would build up in the reactors. The reducing gas can be divided and fed to the reactors in parallel, the gas from all the reactors being recombined and subjected to washing, addition of make-up gas, and recompression, prior to recycling in a plurality of parallel streams. Alternatively, the reducing gas can proceed from the final reactor in reverse order to the passage of iron ore through the reactors, with heating of the gas before each reactor and cooling and washing of the gas after each reactor, followed by addition of make-up and recompression prior to recycling.

4 Claims, 2 Drawing Figures

REDUCTION OF IRON ORE IN FLUIDIZED BED REACTORS

Figure 1:
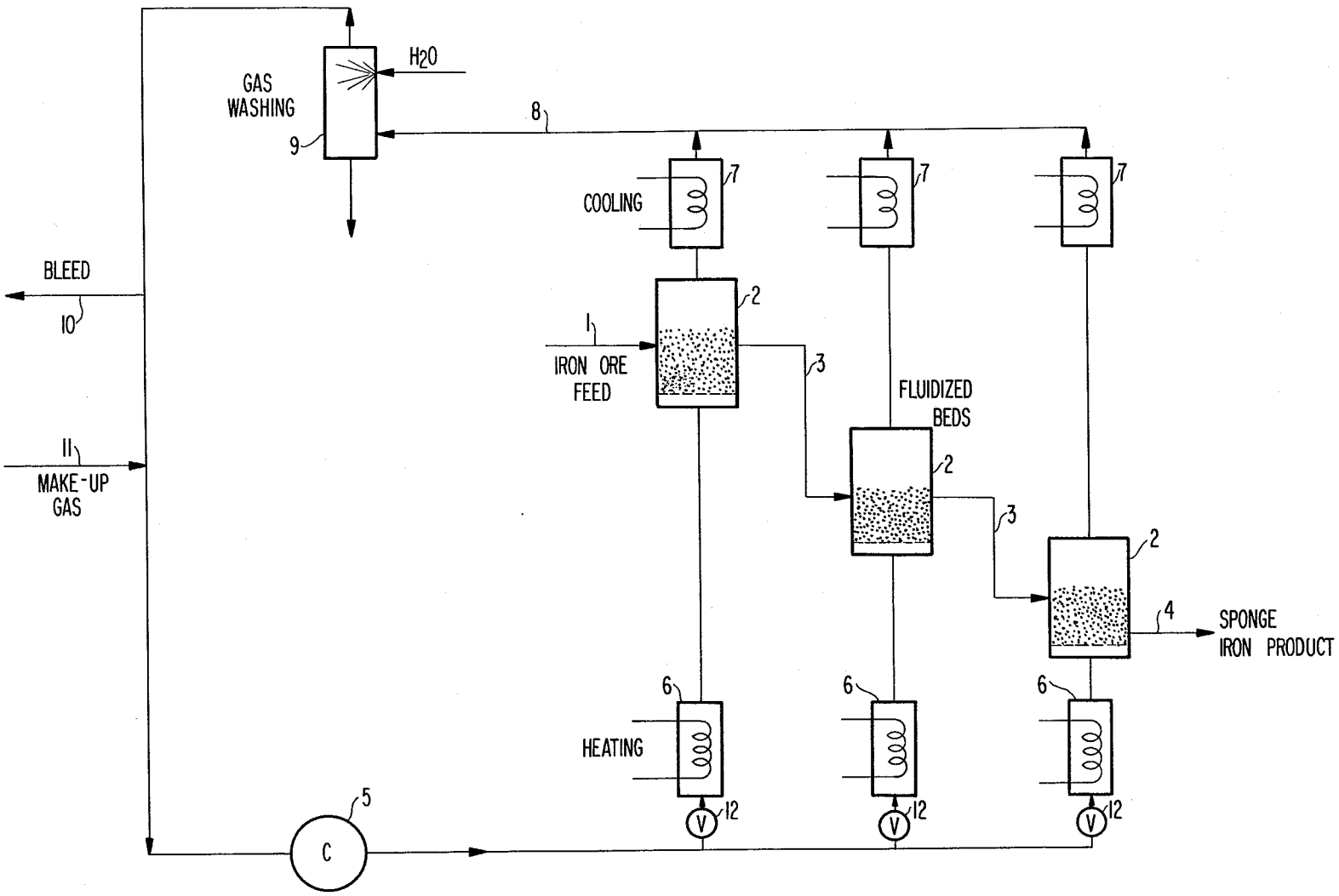

The present invention relates to the direct reduction of iron ore in a reducing gas in fluidized bed reactors.

It is known to conduct the direct reduction of iron ore in a system of fluidized beds to which the iron ore is successively fed in series, with the result that in each bed, the iron ore is progressively reduced until a desired reduction of about 95% is achieved in the final stage. The reducing gas, which is introduced into the bottom of the final reactor, passes in countercurrent to the direction of the iron ore flow through the reactors, and progressively increases in its content of the reaction products. Accordingly, the reducing gas progressively decreases in reducing power.

In known arrangements, each reactor has a large empty space above the fluid bed, in which the ascending gas is initially freed of coarser particles. Such reactors are often provided, ordinarily inside them, with dust-catching equipment, which may for example be of the multi-cyclone type, which further cleanses the reducing gas before it reaches the next reactor in the series.

However, the gas arriving from a fluidized bed is inevitably found to contain a fraction of very fine powder, which is impossible to separate by means of the methods now in use. Such powders when carried by the gas are liable to obstruct the perforations in the plates at the bottom of the fluidized bed which distribute the gas to the reactor and hence create the fluidized bed. Accordingly, the function of these perforated plates is impaired and the creation of a uniform fluidized bed is hindered.

As the gas moves from reactor to reactor in countercurrent to the path of the iron ore, its reducing power decreases but its content of reduced material in the form of a finely divided powder, increases. This reduced material has a greater tendency to stick to the walls of the reactor and to build up as scale and concretion in the narrower passageways of the reactors. Such obstruction results in an uneven distribution of the reducing gas to the fluidized beds. This adversely affects the quality of the fluidization and tends to create preferential gas routes or channels in the bed, through which the ascending gas preferentially flows. Under such circumstances, and particularly in the last reactors of the series, in which the entrained particulate solids are highly reduced, the particles have a marked tendency to agglomerate.

Under these circumstances, the particles tend to stick together and to adhere to the walls of the equipment and to build up ever thicker concretions which can result in complete defluidizing of the bed. The production rate of the plant falls off as a result of the need frequently to shut it down for maintenance.

Accordingly, it is an object of the present invention to provide a process for the direct reduction of iron ore in a plurality of fluidized bed reactors, so as to produce a sponge iron product of high quality.

Another object of the present invention is the provision of such a process, in which the equipment does not become clogged or encrusted with deposits during operation.

Still another object of the present invention is the provision of such a process, which will be relatively simple and inexpensive to practice and will require little maintenance, and which will be reliable in operation.

Briefly, the present invention achieves these objects, according to a first embodiment of the invention, by feeding the recycle gas in parallel to all the fluidized bed reactors. The gas streams leaving the reactors are then recombined and are washed for the removal of particulate solids. Any excess reaction gas is bled and then make-up gas is added to renew the reducing power of the gas, and the gas is then recycled through the individual reactors in separate streams.

In a second embodiment of the invention, the path of the reducing gas is, as in the prior art, through the reactors in series, in countercurrent to the flow of iron ore through the reactors; but the gas stream is subjected to cooling and washing between reactors, and then to heating to bring it up to the desired temperature for reintroduction into the next reactor in the series.

It is also possible to practice the invention with a combination of the two methods described above. The reducing gas introduced into each reactor, however, in any case will be hot and substantially entirely free from solids.

Figure 2:
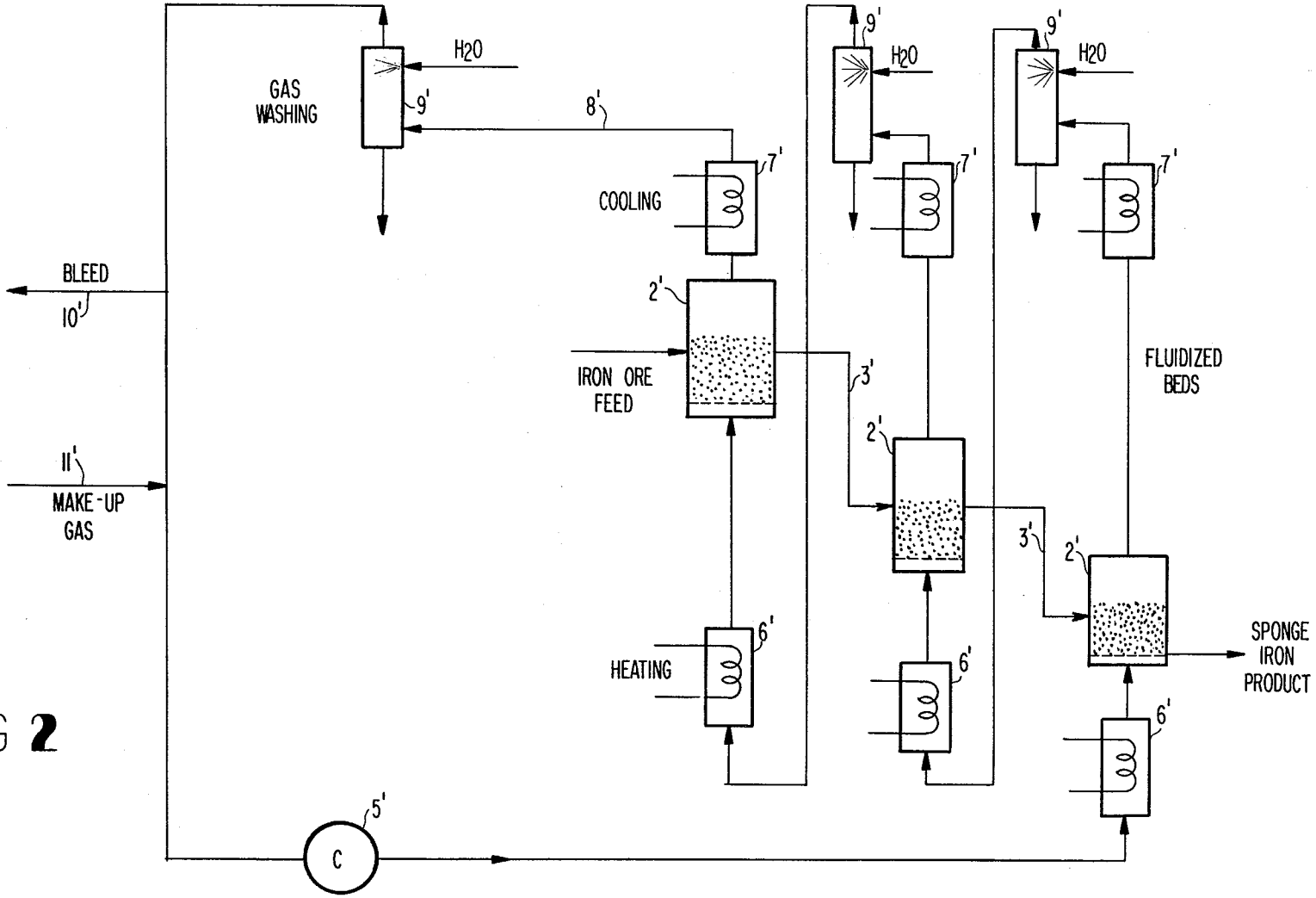

These and other objects, features and advantages of the present invention will become apparent from a consideration of the following description, taken in connection with the accompanying drawings, in which:

FIG. 1 is a flow diagram of a first embodiment of the present invention, characterized by parallel flow of the reducing gas; and FIG. 2 is a view similar to FIG. 1 but showing another embodiment of the invention, characterized by series flow of the reducing gas.

Referring now to the drawings in greater detail, and first to FIG. 1 thereof, there is shown an embodiment of the present invention in which finely divided iron ore is fed through a conduit 1 to a first of a series of reducing reactors in the form of fluidized beds 2 connected in cascade, that is, in series with gravity feed of the progressively more reduced iron ore from bed to bed through conduits 3. A final sponge iron produce is removed through a conduit 4 at the bottom of the last fluidized bed 2.

Reducing gas of conventional composition is circulated by a conventional circulation compressor 5 along a path that branches into a plurality of parallel paths, each parallel path passing through a gas heater 6 by which the gas is heated to a conventional introduction temperature prior to introduction into the corresponding bed 2. A partially spent reducing gas leaves the bed 2 and passes through a gas cooler 7 in which the gas is cooled to below 100° C. and any available heat is recovered and reused in a conventional fashion. The separate parallel gas flows are then recombined into a single stream 8, which is subjected to washing with water sprayed into the top of a washer 9, whereby substantially all of the particulate solids in the gas are removed.

A portion of the washed gas is bled through conduit 10, to keep down the build-up of inert components such as carbon dioxide and nitrogen; and then make-up gas is added at 11 to restore the reducing power of the gas prior to recompression through 5 and recycling. Of course the recompression at 5 is only to the extent necessary to overcome the pressure drop through the system.

The temperatures and composition of the reducing gas, the quantity and composition of the make-up gas, the amount of the bleed, and the flow rate, composition and particle size of the iron ore feed and the degree of reduction of the ore in each of the fluidized beds, are all conventional and well known to persons skilled in this art and so need not be described in greater detail.

An important feature of the embodiment of FIG. 1 is the possibility of separately and independently controlling the quantity of gas that flows to each bed 2, which had not been possible in the past in a series embodiment in which there was no control of the relative quantity of gas that passes through the various reactors. To this end, in the embodiment of FIG. 1, valves 12 are provided in each of the parallel flow paths for the gas, thereby to permit selective individual regulation of the quantity of gas in each said flow path.

A further advantage of FIG. 1 embodiment results from the fact that the reducing gas fed to the first beds encountered by the iron ore, will be of higher reducing power than in the case of the prior art, as it has not previously passed through any fluidized beds; and this results in greater production of sponge iron product.

Turning now to the embodiment of FIG. 2, which is the series embodiment, it will be seen that the reducing gas, downstream of circulation compressor 5', is fed to the last or final bed 2' after passing through the first heater 6'. The partly spent reducing gas leaving this bed reaches the first cooler 7' that recovers any available heat, and then is scrubbed with water in the first washer 9'. The resulting gas is subjected to the same series of treatments in connection with the next fluidized bed 2', and with the final fluidized bed 2', prior to the final washing, bleeding off at 10' to control the build-up of inerts, and addition of make-up gas at 11'.

An advantage shared by both the embodiments of FIGS. 1 and 2, is that the reactor size can be reduced by reducing the empty space above the fluidized beds. It is no longer necessary to use this empty space for gravity separation of solids from the gas, nor is it necessary to provide dry separation equipment in the fluidized beds as has been done in the past. Thus, the gas leaving each fluidized bed need not be as thoroughly freed of fine solid particles as in the past, because it is no longer fed in that same condition to the next reactor upstream.

And of course, as indicated at the outset, a great advantage of the present invention over the prior art is that a better distribution of the gas over and through the perforated plates at the bottom of the fluidized beds is achieved, because clogging of the perforations is prevented, and sticking and coalescing of the solid mass is avoided, thereby to achieve maximum and uniform production.

From a consideration of the foregoing disclosure, therefore, it will be evident that all of the initially recited objects of the present invention have been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What we claim is:

1. A process for the direct reduction of iron ore, comprising establishing a plurality of fluidized beds each of which has a horizontal perforated plate at the bottom thereof, heating and progressively reducing iron ore by passing said iron ore in series through said plurality of fluidized beds, fluidizing said beds with reducing gas by passing said reducing gas up through the perforated plate of each bed, removing partially spent reducing gas from each said bed, cooling and washing said partially spent reducing gas to remove substantially all the solids thereform, heating said washed gas, and again feeding said heated fluidizing gas through a said bed from beneath the perforated plate thereof, all the fluidizing gas that passes between said beds being subjected to said washing between said beds.

2. A process as claimed in claim 1, and feeding said gas to said beds in a plurality of parallel streams, combining said streams, performing said washing step on said combined stream, and dividing said combined stream into said plurality of parallel streams.

3. A process as claimed in claim 2, said selectively regulating the proportion that each of said parallel streams bears to said combined stream.

4. A process as claimed in claim 1, in which said gas flows through said beds in series in the reverse direction from the flow of iron ore through said beds, heating said gas prior to entry into each said bed, cooling said gas after exit from each said bed, and washing the cooled gas prior to heating the gas for entry into the next said bed.

* * * * *